US008009012B2

(12) United States Patent
Kajino et al.

(10) Patent No.: US 8,009,012 B2
(45) Date of Patent: Aug. 30, 2011

(54) STACKED ELECTRONIC PART AND METHOD OF MANUFACTURING THE SAME

(75) Inventors: Takashi Kajino, Tokyo (JP); Hisayuki Abe, Tokyo (JP); Akira Kakinuma, Tokyo (JP); Kazuhiko Itoh, Tokyo (JP)

(73) Assignee: TDK Corporation, Tokyo (JP)

( * ) Notice: Subject to any disclaimer, the term of this patent is extended or adjusted under 35 U.S.C. 154(b) by 550 days.

(21) Appl. No.: 12/219,519

(22) Filed: Jul. 23, 2008

(65) Prior Publication Data

US 2009/0027158 A1 Jan. 29, 2009

(30) Foreign Application Priority Data

Jul. 24, 2007 (JP) ..... 2007-191583
Mar. 17, 2008 (JP) ..... 2008-068230

(51) Int. Cl.
*H01C 1/012* (2006.01)

(52) U.S. Cl. ..... 338/309; 29/610.1; 388/307

(58) Field of Classification Search ..... 338/307, 338/309; 361/311–313, 321.1; 29/25.41, 29/610.1

See application file for complete search history.

(56) References Cited

U.S. PATENT DOCUMENTS

| | | | |
|---|---|---|---|
| 2002/0050909 | A1 | 5/2002 | Jinno et al. |
| 2002/0130318 | A1 | 9/2002 | Kodama et al. |
| 2003/0214793 | A1 | 11/2003 | Uchida et al. |

FOREIGN PATENT DOCUMENTS

| | | |
|---|---|---|
| CN | 1128453 C | 11/2003 |
| JP | A-63-110602 | 5/1988 |
| JP | A-05-246780 | 9/1993 |
| JP | A-07-105719 | 4/1995 |
| JP | A-08-017137 | 2/1996 |
| JP | B2-08-17137 | 2/1996 |
| JP | B2-08-017139 | 2/1996 |
| JP | B2-2561641 | 9/1996 |
| JP | B2-2700978 | 10/1997 |
| JP | A 10-208907 | 8/1998 |
| JP | A-10-214741 | 8/1998 |
| JP | A-2002-52644 | 2/2002 |
| JP | A-2004-297020 | 10/2004 |
| JP | B2-3636075 | 1/2005 |
| JP | A-2005-93707 | 4/2005 |
| JP | A-2006-328475 | 12/2008 |

OTHER PUBLICATIONS

Search Report issued in European Patent Application No. 08013190.7, dated Sep. 15, 2010.

*Primary Examiner* — Kyung Lee
(74) *Attorney, Agent, or Firm* — Oliff & Berridge, PLC

(57) ABSTRACT

Provided are a stacked electronic part that can sufficiently suppress plating deposition on the surface of a porous green body when a terminal electrode is formed on an external electrode, thereby enabling a decrease in the reliability of products to be prevented, and a method of manufacturing the stacked electronic part. The stacked electronic part 1 is a PTC thermistor having a stacked body 4 containing a porous green body 2 made of ceramics and having a plurality of vacancies and a plurality of internal electrodes 3 formed within the porous green body 2, and is provided with at least one unit structure 10 in which the porous green body 2 and the internal electrode 3 are stacked. External electrodes 5, 5 are connected to the internal electrode 2, and upon the external electrodes 5, 5 are formed terminal electrodes 7, 7 by plating. Resin is filled in the plurality of vacancies of the porous green body 2 at a filling ratio of not less than 60%.

3 Claims, 13 Drawing Sheets

STACKED ELECTRONIC PART AND METHOD OF MANUFACTURING THE SAME

BACKGROUND OF THE INVENTION

The present invention relates to a stacked electronic part having a stacked structure provided with a green body made of ceramics and an internal electrode and a method of manufacturing the stacked electronic part.

In general, a stacked electronic part formed from a thermistor, a capacitor, an inductor, LTCC (Low Temperature Co-fired Ceramics) and a varistor that has a ceramic green body, an internal electrode and an external electrode, and from a complex thereof is mounted on a wiring board, such as a printed circuit board, and the external electrode is soldered in a prescribed connection point. On that occasion, if an terminal electrode composed of an Ni layer and an Sn layer is formed, by plating, on an external electrode (a front-end electrode) made of, for example, Ag, is used, the bonding properties of a solder to the substrate are improved and productivity can be improved.

In order to prevent the worsening of the electrical properties of a stacked electronic part that is caused by the entry of a plating electrolyte into the green body of the part in the plating process for forming such a terminal electrode, for example, Japanese Patent No. 2700978 proposes an electronic part which is such that a silicone resin or a phenol resin is impregnated in all pores that are present on the surface part of a ceramic green body of the electronic part.

Incidentally, when the present inventors examined the physical properties and electrical properties of the above-described various kinds of stacked electronic parts in which a terminal electrode is formed on an external electrode by plating, it became evident that for example, in a stacked electronic part having a porous ceramic green body, such as a PTC (Positive Temperature Coefficient) thermistor, in particular, the surface and the subsurface part of the green body, and even the interior of the green body may sometimes be plated, with the result that a decrease in the insulating characteristics between external electrodes or a short circuit occurs, and that occasionally the plating reaches an internal electrode, posing the problem that the functions of the products are lost.

Specifically, when external electrodes (front-end electrodes) were formed at both ends of a PTC thermistor and the formation of Ni/Sn terminal electrodes was performed by electroplating, which was barrel plating, the plating was deposited on the whole surface of the ceramic green body. As a result of an examination of the element distribution of Ni and Sn on a section of this green body by use of an EPMA (Electron Probe Microanalyzer), it became apparent that a large amount of Ni is deposited on the subsurface part and that Ni is deposited also in a deeper part. From this, it is estimated that the plating liquid enters the interior of open pores that reach an internal electrode and that by the power supply from the internal electrode, the plating becomes deposited and grows from the interior of the green body. Such a phenomenon of plating deposition to a green body is similarly observed also when electroless plating using a catalyst is started and when electroless plating is started by the contact process without using a catalyst. Also in this case, it is estimated that plating becomes deposited and grows from the interior of open pores that reach the internal electrode. In contrast to this, when the whole surface of a ceramic green body was impregnated with a silicone resin by using a conventional method disclosed in Japanese Patent No. 2700978, it was ascertained that under some resin impregnation conditions, the deposition of a plating on the ceramic green body cannot be sufficiently suppressed.

Therefore, the present invention has been made in view of the above-described circumstances and has as its object the provision of a stacked electronic part that can sufficiently suppress plating deposition on the surface of a porous green body made of ceramics even when a terminal electrode is formed on an external electrode by plating, thereby enabling a decrease in the reliability of products to be prevented, and of a method of manufacturing the stacked electronic part.

SUMMARY OF THE INVENTION

To solve the above-described problem, the present inventors paid attention to the relationship between the physical properties of green body materials that can cause plating deposition on the surface of a porous ceramic green body of a stacked electronic part and the conditions observed when plating deposition occurs and the filling ratio of resin observed when the resin is impregnated in vacancies of the green body, and devoted themselves to studies, and as a result, they finally completed the present invention. That is, a stacked electronic part (component) according to the present invention comprises: a stacked body that has a porous green body made mainly of ceramics and containing a plurality of vacancies and at least one internal electrode provided within the porous green body; an external electrode connected to the internal electrode; and a terminal electrode formed on the external electrode by plating, in which the porous green body is such that resin is filled in the plurality of vacancies at a filling ratio of not less than 60%.

Incidentally, the "vacancies" contained in the porous green body in the present invention are equivalent to "pores" specified in Japanese Industrial Standard JIS Z2500 and Japanese Industrial Standard JIS Z2501. The "filling ratio" of resin in a porous green body is a value measured as follows. That is, first, a stacked electronic part that is in a condition before a terminal electrode is formed by plating is dried at atmospheric pressure at 150° C. for 1 hour so that the moisture of the stacked electronic part is evaporated, and the weight of the stacked electronic part is measured (weight: m1). Next, the stacked electronic part is immersed in water and held for 30 minutes in a vacuum, whereby water is impregnated in vacancies and the weight of the stacked electronic part is measured (weight: m2). Furthermore, after the stacked electronic part is dried at atmospheric pressure at 200° C. for 1 hour, unset (uncured) resin (a monomer in the case of a polymerization resin) is impregnated in the porous green body so that the resin dose not become deposited on an external electrode, the resin is dried and set (heated and set, polymerized), and the weight of this stacked electronic part is measured (weight: m3). And the "filling ratio" of the resin is calculated by substituting the above-described weight m1, m2 and m3 and the density ρ of the resin in a dried and set (cured) condition in a relational expression expressed by the following equation (1):

$$\text{Filling ratio (\%)}=100\times(m3-m1)/\{(m2-m1)\times\rho\} \quad (1)$$

In a stacked electronic part thus constructed, resin is filled in the vacancies of a porous green body and the vacancies opened (open pores) in the porous green body are clogged by the resin. Therefore, when a terminal electrode is formed on an external electrode by plating, the plating liquid is prevented from entering the interior of the porous green body and reaching the internal electrode, whereby the plating is prevented from being deposited and growing. And according to the knowledge of the present inventors, it has been ascertained that when the filling ratio of the resin is not less than 60%, the ratio of plating deposition on the surface of the porous green body (the proportion of the area of plating deposition on the exposed area) is sufficiently reduced to not more than approximately 5%. Incidentally, if a resin layer is formed on the exposed surface of the porous green body, preferably substantially the whole exposed surface, the barrier effect of the porous green body is further increased and hence such a condition is preferred.

It was ascertained that when a PTC thermistor obtained by a method similar to the conventional method disclosed in Japanese Patent No. 2700978 is subjected to heat treatment, such as reflow, and when such a PTC thermistor is exposed to a high-temperature environment due to heating during packaging and due to heating up during actuation, poor PTC characteristics, such as a significant decrease in the resistance value at high temperatures, may occur under some resin impregnation conditions. It might be thought that this is because probably a flux used in the soldering of an electronic part, such as a PTC thermistor, flows into the open pores of the porous green body during heating and the green body made of ceramics is reduced by the remaining flux.

In contrast to this, it was ascertained that in a stacked electronic part of the present invention, the occurrence of such poor PTC characteristics can be significantly suppressed and particularly, it became evident that when the filling ratio of resin in a porous green body is not less than 70%, a flux is sufficiently prevented from flowing into the interior of the porous green body during or after the packaging of a stacked electronic part in a wiring board and the like, whereby the ratio of occurrence (frequency) of poor characteristics can be substantially reduced.

Furthermore, when the evaluation of the temperature characteristics of a PTC thermistor obtained by the above-described conventional method was performed, it was also ascertained that significant amounts of individual pieces in which bloating (what is called "bursting") occurs from the ceramic green body are produced under some resin impregnation conditions. It might be thought that this is because under the conventional method, vacancies remain in the interior of the ceramic green body although the pores on the surface of the green body are clogged, and the air in the interior of the vacancies expands and bursts when subjected to high temperatures.

In contrast to this, it was ascertained that in a stacked electronic part of the present invention, the occurrence of such "bursting" can be effectively suppressed and it became apparent that in particular, when the resin filling ratio in a porous green body is not less than 80%, it is possible to substantially reduce the ratio of occurrence (frequency) of "bursting."

The present invention is more useful when the porous green body is a burned body (a sintered compact) and its sintered density (measured density/theoretical density× 100%) is not less than 90%. That is, according to the studies conducted by the present inventors, it was ascertained that plating deposition on the surface of a porous green body is scarcely observed during the forming of a terminal electrode when the porous green body having a sintered density exceeding 90% is used, whereas the rate of plating deposition on the surface of the porous green body increases abruptly as the sintered density decreases. It might be thought that this is because open pores scarcely occur when the sintered density of a porous green body exceeds 90% and even when vacancies are generated, most of them are closed pores and the plating liquid does not enter, whereas the total number of open pores and the ratio of open pores to all vacancies increases abruptly when the sintered density becomes not more than 90%. Therefore, the operation and effect of the present invention are more advantageously realized when the present invention is applied to a stacked electronic part having a porous green body with a sintered density of not more than 90%, in which such a large number of open pores can be formed.

When a stacked electronic part of the present invention further includes an overcoat layer that covers the external electrode, the corrosion of the external electrode by the plating liquid can be positively prevented when a terminal electrode is formed on the surface of the external electrode by plating.

Furthermore, a method of manufacturing a stacked electronic part according to the present invention, which is a method for effectively manufacturing the stacked electronic part of the present invention, comprises the steps of: forming a stacked structure by providing at least one internal electrode within a porous green body made mainly of ceramics and containing a plurality of vacancies; forming a stacked body (a sintered compact) by burning (sintering) the stacked structure; applying an electrically conductive paste to the stacked body so as to obtain an electrical connection to the internal electrode of the stacked body; forming an external electrode by burning (sintering) the electrically conductive paste; filling resin in the plurality of vacancies at a filling ratio of not less than 60%, preferably not less than 70%, most preferably not less than 80% by impregnating resin in the porous green body; and forming a terminal electrode on the external electrode by plating.

DETAILED DESCRIPTION OF THE PREFERRED EMBODIMENTS

Figure 1:
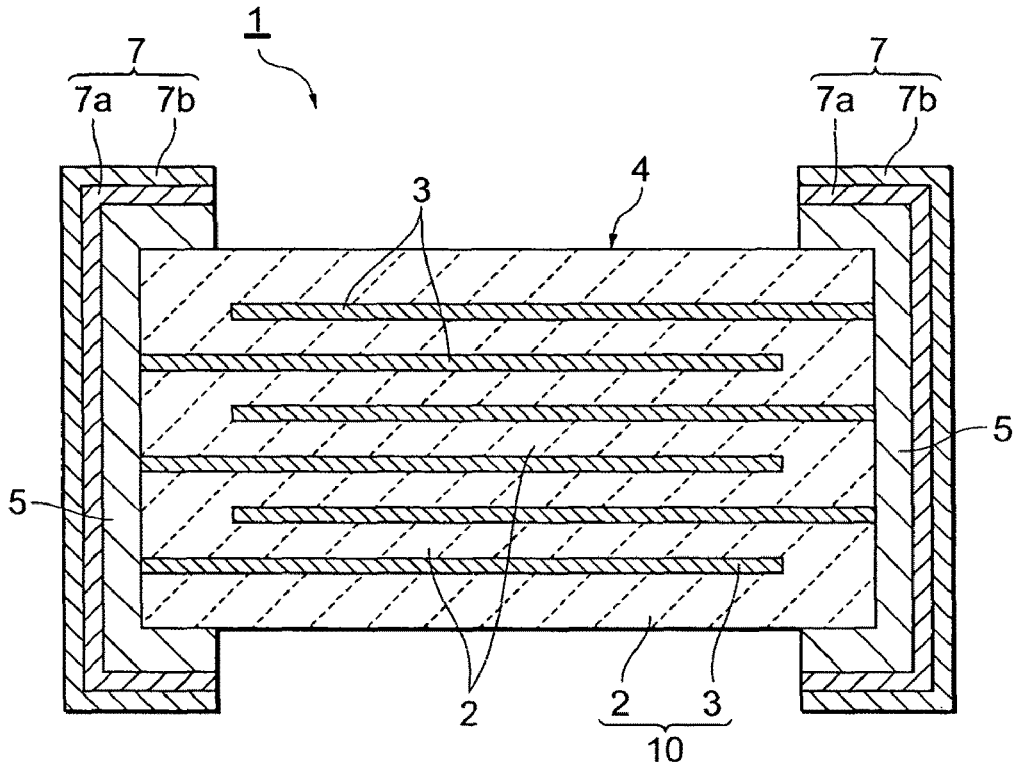
FIG. 1 is a sectional view showing the schematic construction of the first embodiment of a stacked electronic part according to the present invention.

Embodiments of the present invention will be described below with reference to the drawings. Incidentally, in the drawings, like reference characters refer to like elements and overlapping descriptions are omitted. The positional relationships such as, right and left, up and down, are based on the positional relationships shown in the drawings unless otherwise noted. Furthermore, the dimensional ratios of the drawings are not limited to those shown in the drawings. The following embodiments are illustrative for describing the present invention and are not intended for limiting the present invention to the embodiments alone. Furthermore, various modifications are possible so long as they do not depart from the gist of the present invention.

First Embodiment

FIG. 1 is a sectional view showing the schematic construction of the first embodiment of a stacked electronic part according to the present invention. The stacked electronic part 1 is a PTC thermistor having a stacked body 4 that includes a porous green body 2 made mainly of ceramics and containing a plurality of vacancies and a plurality of internal electrodes 3 formed within the porous green body 2. In other words, the stacked electronic part 1 is provided with at least one unit structure 10 in which the porous green body 2 and the internal electrodes 3 are stacked. More concretely, an internal electrode 3 having an end portion exposed to one side surface of the stacked body 4 and an internal electrode 3 having an end portion exposed to the other side surface of the stacked body 4 are alternately stacked.

On both side surfaces of the stacked body 4, there are provided external electrodes 5, 5 so as to cover these side surfaces, and each of the external electrodes 5 is electrically connected to a group of the internal electrodes 3 exposed from one side surface of the stacked body 4 or a group of the internal electrodes 3 exposed from the other side surface of the stacked body 4.

Furthermore, on the outer side of the external electrodes 5, 5, terminal electrodes 7, 7 are formed by plating. These terminal electrodes 7, 7 and electrodes on a wiring board (not shown) are joined together by soldering, for example. Each of the terminal electrodes 7 has a two-layer construction including a Ni layer 7*a* and a Sn layer 7*b*, which are formed by laminating from the external electrode 5 side. The Ni layer 7*a* functions as a barrier metal that prevents contact between the Sn layer 7*b* and the external electrode 5 and thereby prevents the corrosion of the external electrode 5 by Sn, and the thickness of the Ni layer 7*a* is, for example, on the order of 2 μm. The Sn layer 7*b* has the function of improving the wettability of solder and the thickness thereof is, for example, on the order of 4 μm.

In the fabrication of a PTC thermistor as the stacked electronic part 1 as in this embodiment, as described above, it is necessary that the porous green body 2 be made of ceramics, concretely, semiconductor ceramics, and more concretely, the porous green body 2 is made of barium titanate-based ceramics. In the barium titanate ceramics, as required, part of Ba may be replaced by Ca, Sr, Pb and the like or part of Ti may be replaced by Sn, Zr and the like. As donor elements added to obtain barium titanate-based semiconductor ceramics, it is possible to use rare earth elements, such as La, Y, Sm, Ce, Dy and Gd, and transition elements, such as Nb, Ta, Bi, Sb and W. Furthermore, as required, $SiO_2$, Mn and the like may also be appropriately added to such barium titanate-based semiconductor ceramics.

By forming the porous green body 2 from barium titanate-based semiconductor ceramics, the characteristics of a PTC thermistor (PTC characteristics) that the electric resistance rises abruptly at the Curie temperature can be satisfactorily obtained. Examples of uses of such a PTC thermistor include overcurrent protection, constant-temperature heating elements and overheat detection.

Although methods of synthesizing a barium titanate-based semiconductor ceramic powder used in forming the porous green body 2 are not especially limited, for example, the hydrothermal method, the hydrolysis method, the coprecipitation method, the solid phase method, the sol-gel method and the like can be used, and calcination may be performed as required.

The porous green body 2 is such that resin is filled in a plurality of vacancies at a filling ratio of not more than 60%, preferably not less than 70%, more preferably not less than 80%. When this resin filling ratio is not less than 60%, during the formation of the terminal electrode 7 by plating, it is possible to sufficiently prevent the plating liquid from entering the interior of the porous green body 2 from open pores contained in the porous green body 2 and thereby reaching the internal electrodes, causing the deposition and growth of the plating. Furthermore, when the resin filling ratio in the porous green body 2 is not less than 70%, it is possible substantially reduce the occurrence ratio of poor characteristics caused by the inflow and remaining of a flux in the porous green body, which is feared, for example, during the packaging of the stacked electronic part 1, and particularly when the resin filling ratio becomes not less than 80%, in a case where the stacked electronic part 1 is exposed to high temperatures, it is possible to suppress the occurrence of "bursting" that may be induced by the expansion and bursting of the air in the interior of the vacancies to an exceedingly low extent.

When a resin layer is formed on the exposed surface of the porous green body 2, preferably substantially the whole exposed surface, the barrier effect of the porous green body 2 is further increased and hence such a condition is preferred. Incidentally, the higher the coverage ratio of the surface of the porous green body 2 by the resin layer, the more preferred, so long as there is no problem in handling, because the entry of the plating liquid into the open pores is prevented.

Figure 2:
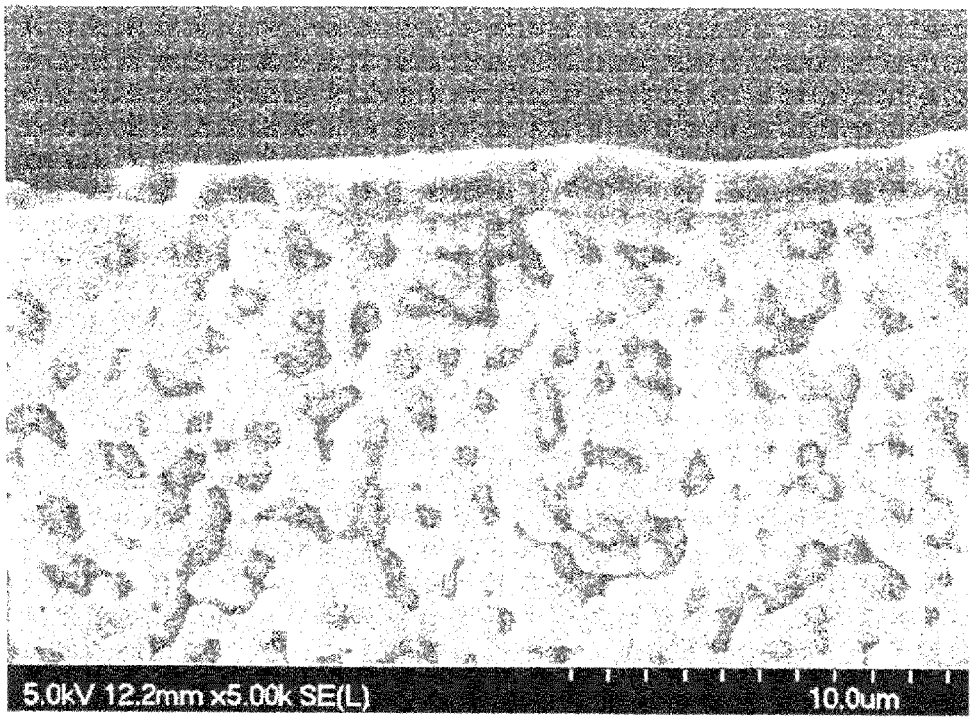
FIG. 2 is an enlarged photograph showing a subsurface section of an example of an actual porous green body 2 filled with resin at a filling ratio of not less than 60%.

FIG. 2 is an enlarged photograph showing a subsurface layer section of an example of an actual porous green body 2 filled with resin at a filling ratio of not less than 60%. A plurality of vacancies are formed in the interior of the porous green body 2, it is ascertained that many of the open pores are in communication with internal vacancies, and it is apparent that as shown in the figure, these vacancies are filled with resin and that a resin layer is formed on the surface of the porous green body 2.

Kinds of resins used in filling the vacancies of the porous green body 2 are not especially limited, and any of monomers, polymers and prepolymers (oligomers) may be used so long as it can be impregnated in the porous green body 2 and can then be set. In the case of resins that are set by a polymerization reaction after impregnation, examples of such resins include preferably, epoxy resins, phenol resins, and addition polymerization type (addition polymerization reactive) silicone resins and among these, it is more preferred to use addition polymerization type resins. Examples of monomers for obtaining addition polymerization type resins include those having unsaturated reaction groups, particularly preferably, those having (meta)acryloyl groups, vinyl groups or derivative groups thereof.

If dehydration condensation type resins are used, water is generated as a reaction product during polymerization and the water is discharged from the interior of the vacancies of the porous green body 2 and this can generate voids. In contrast to this, if addition polymerization type resins are used, water is not generated during polymerization and setting and, therefore, the occurrence of voids is suppressed and the filling ratio of vacancies of the porous green body 2 can be raised compared to the case where dehydration condensation type resins are used.

The porous green body 2 is a sintered compact and the sintered density thereof is not especially limited. However, when the sintered density is not more than 90%, the above-described effect of resin filling is remarkably exhibited. That is, when the sintered density of the porous green body 2 exceeds 90%, the amount of the plating deposited on the surface of the porous green body 2 during the forming of the terminal electrode 7 by plating is not significant. In contrast to this, when the sintered density becomes not more than 90%, the number of open pores of the porous green body 2 and the ratio of the open pores increase with decreasing sintered density, resulting in a tendency for the rate of plating deposition on the surface of the porous green body 2 to increase abruptly. Therefore, when the porous green body 2 has a sintered density of not more than 90% at which such a large number of open pores can be formed, the open pores are filled with the resin and hence the plating deposition on the surface of the porous green body 2 can be effectively suppressed.

On the other hand, in the internal electrode 3, a material whose main component is, for example, Ni, Cu or Al is used in order to ensure positive ohmic contact between the porous green body 2 and the internal electrode 3, and alloy metals or composite materials of these metals may also be used. By using the porous green body 2 that permits low-temperature burning, Cu (melting point: 1083° C.) and Al (melting point: 660° C.) having a lower melting point than Ni (melting point: 1450° C.) can be used.

On the other hand, the external electrode 5 is obtained, for example, by applying an electrically conductive paste to the side surface of the stacked body 4 and burning the electrically conductive paste. Examples of the electrically conductive paste for forming the external electrode 5 include those containing mainly a glass powder, an organic vehicle (binder) and a metal powder, and the organic vehicle is volatilized by the burning of the electrically conductive paste and eventually, the external electrode 5 containing a glass component and a metal component is formed. Incidentally, as required, various additives, such as a viscosity regulator, an inorganic binder and an oxidizer, may also be added to the electrically conductive paste.

In the present invention, the external electrode 5 contains Ag and Al and the like, for example, as metal components, and interposing of Al and the like in a junction part of Ni, Cu or Al which consists of the internal electrode 3 with Ag contained in the external electrode 5 increases the junction area between the internal electrode 3 and the external electrode 5, which enables connection resistance to be sufficiently reduced and even the mechanical bonding strength between the internal electrode 3 and the external electrode 5 to be increased.

Next, a method of manufacturing a stacked electronic part 1 related to the above-described embodiment will be described with reference to FIGS. 3 to 7. FIGS. 3 to 7 are process drawings showing an example of a procedure for manufacturing the stacked electronic part 1.

First, as the starting raw material, prescribed amounts of $BaCO_3$, $TiO_2$ and a nitric acid Sm solution are mixed and put in a pot made of polyethylene along with pure water and zirconia balls, and pulverized and mixed for five hours. After that, the mixed liquid is evaporated and dried, and a mixed powder thus obtained is temporarily burned at 1100° C.

Next, the temporarily burned powder is pulverized again using pure water and zirconia balls for 5 to 30 hours by use of a ball mill and after that, evaporation and drying are performed, and a barium titanate semiconductor ceramic powder is obtained. For example, a barium titanate semiconductor ceramic powder whose chemical composition is $(Ba_{0.9985}Gd_{0.0015})_{0.995}(Ti_{0.9985}Nb_{0.0015})O_3$ is obtained.

Figure 3:
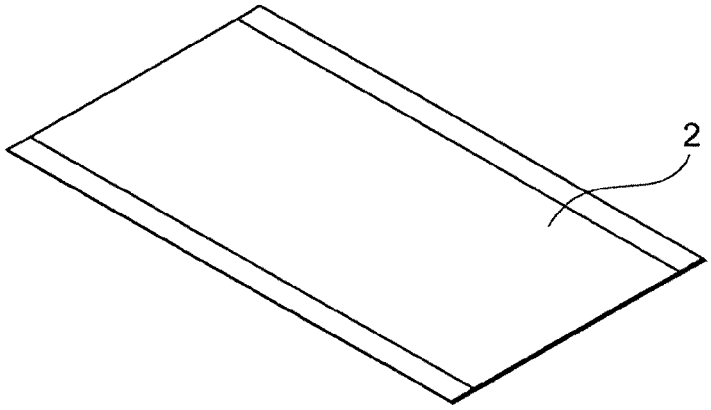
FIG. 3 is a process drawing showing an example of a procedure for manufacturing a stacked electronic part.

Next, the obtained powder is made into a ceramic slurry by adding an organic solvent, an organic binder, a plasticizer and the like thereto, and after that, the ceramic slurry is shaped by the doctor blade method, whereby a sheet-like porous green body 2 shown in FIG. 3, what is called a ceramic green sheet is obtained.

Figure 4:
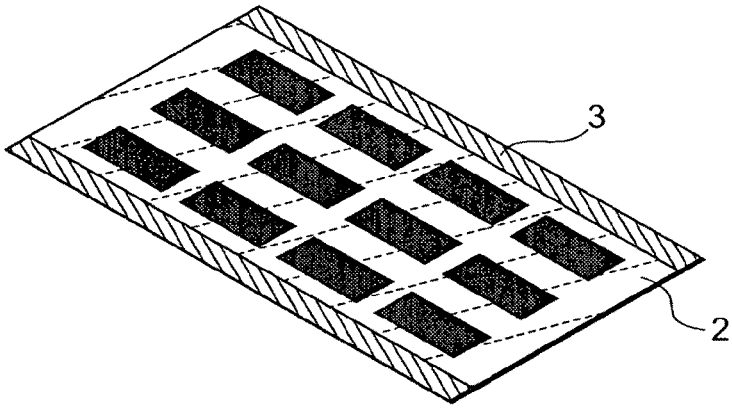
FIG. 4 is a process drawing showing an example of a procedure for manufacturing a stacked electronic part.

Furthermore, as shown in FIG. 4, an electrically conductive paste containing Ni, Cu or Al as metal components is screen printed on the sheet-like porous green body 2, whereby a pattern of the internal electrode 3 is formed.

Figure 5:
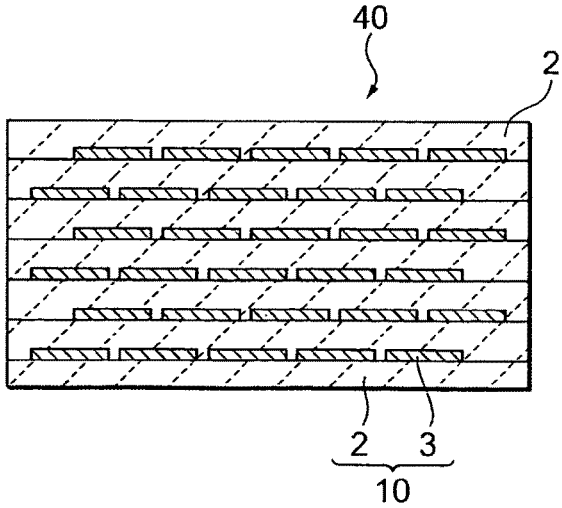
FIG. 5 is a process drawing showing an example of a procedure for manufacturing a stacked electronic part.

Next, as shown in FIG. 5, a plurality of porous green bodies 2 in which the internal electrode 3 is formed and a plurality of porous green bodies 2 in which the internal electrode 3 is not formed are alternately stacked, and these porous green bodies 2 are further pressurized, whereby a stacked structure 40 is obtained.

Figure 6:
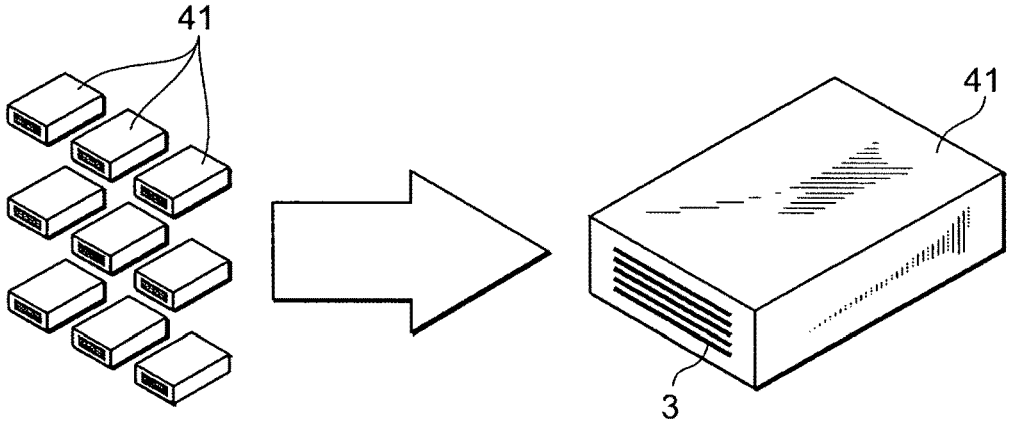
FIG. 6 is a process drawing showing an example of a procedure for manufacturing a stacked electronic part.

Then as shown in FIG. 6, the stacked structure 40 is cut, whereby the stacked structure 40 is divided into individual stacked structures 41. The stacked structure 41 after the cutting is such that end portions of the internal electrodes 3 are exposed from a side surface of the stacked structure 41.

Next, the stacked structure 41 is subjected to binder burn-out treatment in the atmosphere and then burned at 1300° C. for 2 hours in a strongly reducing atmosphere of $H_2/N_2=3/100$, whereby a sintered stacked body 4 is obtained. After that, the sintered stacked body 4 is subjected to re-oxidizing treatment in the atmosphere at temperatures between 600° C. and 1000° C.

Figure 7:
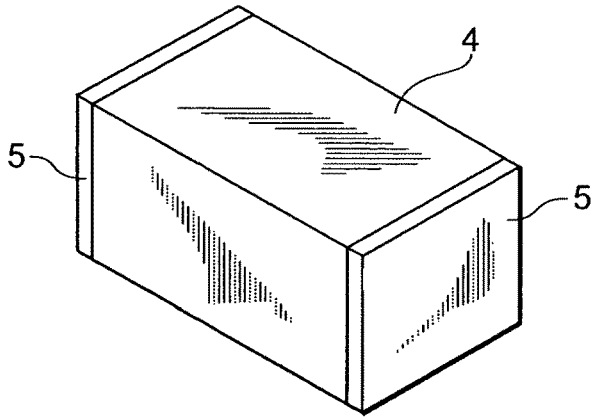
FIG. 7 is a process drawing showing an example of a procedure for manufacturing a stacked electronic part.

Subsequently, as shown in FIG. 7, an electrically conductive paste containing Ag and Al and the like is applied to side surfaces of the stacked body 4 and burned in the atmosphere at temperatures between 600° C. and 1000° C. for 1 hour to several hours.

Next, the resin filling of the porous green body 2 is performed. Filling methods are not especially limited, and examples of filling methods capable of being mentioned include (1) a method that involves immersing the whole porous green body 2 in an unset resin (a monomer and a prepolymer in the case of a polymerization resin, the same being applied to the following), with the parts of the external electrodes 5, 5 covered with an appropriate member, and holding the porous green body 2 for a specified time, whereby the resin is impregnated in the vacancies of the porous green body 2 and thereafter the resin is set by heating; (2) a method that involves immersing the whole porous green body 2 in an unset resin, without covering the parts of the external electrodes 5, 5, removing the resin deposited on the external electrodes 5, 5 with a solvent and the like, and then setting the resin by heating; and (3) a method of injecting unset resin under pressure from the exposed surfaces of the porous green body 2.

Incidentally, the resin filling ratio of the porous green body 2 can be adjusted by performing resin impregnation once or repeating the resin impregnation a plurality of times and by appropriately adjusting the number of times, and the larger the number of times, the more the resin filling ratio can be raised. Or alternatively, the resin filling ratio of the porous green body 2 can also be adjusted by adjusting the viscosity of the resin. In some kinds of resins, for example, in the case of silicone resins, it is possible to show by example a technique that involves performing heating at 70° C. for 30 minutes and then performing heating at 180° C. for 1 hour as heating and setting conditions. Furthermore, in the polymerizing and setting of a monomer or a prepolymer by heating, if the resin is also an ultraviolet-curable resin, irradiation with ultraviolet rays and heating may be performed simultaneously in order to promote the bridging of a resin layer on the surface of the porous green body 2.

Furthermore, as shown in FIG. 2, in order to form a resin layer on the surface of the porous green body 2, after the impregnation of the porous green body 2 with resin, it is necessary only that the resin be thermoset, with the porous green body 2 not cleaned or not thoroughly cleaned.

Furthermore, as shown in FIG. 1, the Ni layer 7*a* and the Sn layer 7*b* are sequentially deposited on the surface of the external electrode 5 by electroplating, whereby the terminal electrode 7 is formed. For example, in the formation of the Ni layer 7*a*, the barrel plating method is adopted and Ni is precipitated in a thickness of 2 μm by using a Watt bath. In the formation of the Sn layer 7*b*, the barrel plating method is adopted and Sn is precipitated in a thickness of 4 μm by using a neutral tinning bath. After that, a solder is formed on the terminal electrode 7 or on an electrode of an unillustrated wiring board and the terminal electrode 7 and the electrode of the wiring board are electrically connected by melting the solder.

According to this method of manufacturing the stacked electronic part 1, the electrically conductive paste for the external electrode 5 can be burned in the atmospheric environment. As a result of this, compared to the case where burning is performed in a reducing atmosphere, atmosphere control becomes easy and, therefore, the cost of manufacturing can be reduced. Also, as described above, particularly in a case where a PTC thermistor is fabricated, if an electrically conductive paste for the external electrode is burned in a reducing atmosphere, a stacked body does not exhibit the PTC characteristics. However, according to the present invention, it is possible to form the external electrode 5 while maintaining the PTC characteristics of the stacked body 4.

Second Embodiment

Figure 8:
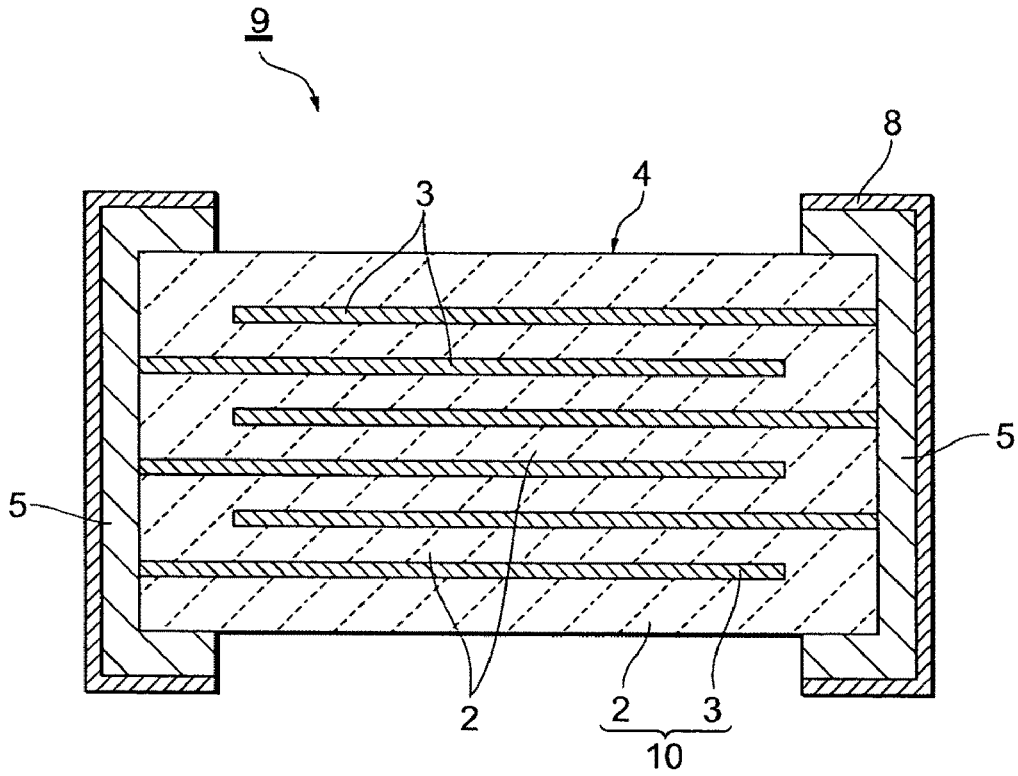
FIG. 8 is a sectional view showing the schematic construction of the second embodiment of a stacked electronic part according to the present invention.

FIG. 8 is a sectional view showing the schematic construction of the second embodiment of a stacked electronic part according to the present invention. A stacked electronic part 9 is constructed in the same manner as the stacked electronic part shown in FIG. 1, with the exception that an overcoat layer 8 containing Ag as a metal component is formed so as to cover an external electrode 5. This overcoat layer 8 can be formed by printing and burning an electrically conductive paste containing, for example, Ag. Incidentally, though not illustrated, in FIG. 8, terminal electrodes 7, 7 are formed in a stacked manner on the outer side of the overcoat layers 8, 8.

According to the stacked electronic part 9 of this construction, because of the formation of the overcoat layer 8 on the surface of the external electrode 5, it is possible to more positively prevent the Al and the like that are contained in the external electrode 5 from being corroded by the plating liquid for forming the terminal electrode 7 as shown in FIG. 1.

Incidentally, as described above, the present invention is not limited to the above-described embodiments, and can be appropriately changed within the scope without departure from the gist of the present invention. For example, in the stacked electronic part 1, the resin impregnation of the porous green body 2 may be performed before the formation of the external electrode 5, and in the stacked electronic part 9, the resin impregnation of the porous green body 2 may be performed before or after the formation of the external electrode 5 or after the formation of the overcoat layer 8. Furthermore, the porous green body 2 may be made of ceramics and it is not always necessary that the porous green body 2 be made of semiconductor ceramics. For example, when a stacked ceramic capacitor is fabricated as the stacked electronic parts 1, 9, it is possible to use a porous green body 2 made of insulating ceramics. Furthermore, it is necessary only that the internal electrode 3 be formed in quantities of at least one.

Examples of the present invention will be described below. However, the present invention is not limited by these examples.

<Manufacturing of PTC Thermistor>

In the same manufacturing procedure as described above, a stacked body 4 with a size of 3.2 mm×1.6 mm×0.5 mm having a porous green body 2 whose chemical composition is $(Ba_{0.9985}Gd_{0.0015})_{0.995}(Ti_{0.9985}Nb_{0.0015})O_3$ and a plurality of internal electrodes 3 made of Ni was fabricated, and electrically conductive pastes having different Al and Ag contents were applied to side surfaces of this stacked body 4 and burned in the atmospheric environment at 600° C., whereby external electrodes 5 were formed. After an addition polymerization type silicone monomer was impregnated in this porous green body 2, the resin was polymerized and set under the heating conditions that involve heating at 70° C. for 30 minutes followed by heating at 180° C. for 1 hour. Furthermore, upon the external electrodes 5, 5, terminal electrodes 7, 7 were formed by barrel plating, which involved depositing Ni in a thickness of 2 μm using a Watt bath and depositing Sn in a thickness of 4 μm using a neutral tinning bath, whereby a PTC thermistor as a stacked electronic part was obtained.

EXAMPLES 1 TO 5

By changing the resin filling ratio of the porous green body 2 whose sintered density is 80%, a plurality of five kinds of PTC thermistors each having a resin filling ratio of not less than 60% according to the present invention were manufactured by following the above-described procedure for manufacturing PTC thermistors. Incidentally, impregnation was performed once or repeated a plurality of times, and the resin filling ratio was appropriately adjusted by the times of number of impregnation.

COMPARATIVE EXAMPLE 1

A plurality of PTC thermistors with a resin filling ratio of 0% were manufactured by following the same procedure as the above-described procedure for manufacturing PTC thermistors, with the exception that a porous green body having a sintered density of 80% was not impregnated or filled with resin.

COMPARATIVE EXAMPLES 2 TO 4

By changing the resin filling ratio of the porous green body whose sintered density is 80%, a plurality of PTC thermistors with a resin filling ratio of less than 60% were manufactured by following the above-described procedure for manufacturing PTC thermistors.

Figure 9:
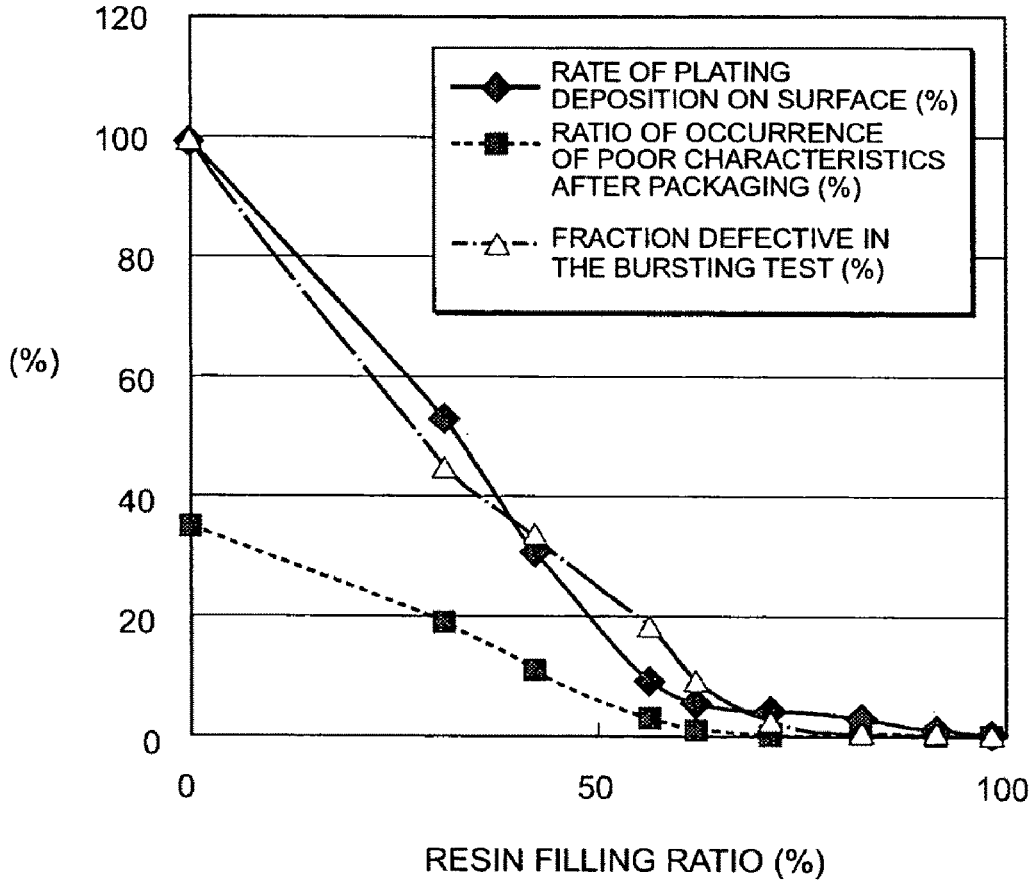
FIG. 9 is a graph showing the rate of plating deposition on the surface, the characteristics fraction defective after packaging, and the fraction defective in the bursting test relative to the resin filling ratio of a porous green body.

Test Evaluation 1:

Evaluation Test 1:

For the PTC thermistors obtained in each examples and the comparative examples, the rate of plating deposition on the surface of the porous green body (%), the ratio of occurrence of poor characteristics after the packaging of a PTC thermistor on a wiring board (%), and the fraction defective in the bursting test (%) were measured and evaluated. The rate of plating deposition on surface (%) was calculated from the area of a plated region relative to the exposed area of a porous green body of a PTC thermistor. For the ratio of occurrence of poor characteristics after packaging (%), after the mounting of 100 samples for each PTC thermistor on a wiring board by reflow treatment, the proportion of the number of samples in which the resistance value at 200° C. decreased 10% from the resistance value before the reflow was calculated. For the fraction defective in the bursting test (%), after the immersion of 100 samples for each PTC thermistor in a silicone oil at 260° C., the proportion of the number of samples in which bloating occurred from a porous green body was calculated. The results are summarized in Table 1. FIG. 9 is a graph of the data of Table 1.

TABLE 1

| | | | | | | | | | |
|---|---|---|---|---|---|---|---|---|---|
| Pore filling ratio (%) | 0 | 31 | 42 | 56 | 62 | 71 | 82 | 91 | 98 |
| Rate of plating deposition on surface (%) | 100 | 53 | 31 | 9.1 | 5.1 | 4.5 | 3.2 | 1.2 | 0.5 |
| Ratio of occurrence of poor characteristics after packaging (%) | 35 | 19 | 11 | 3 | 1 | 0 | 0 | 0 | 0 |
| Fraction defective in the bursting test (%) | 100 | 45 | 33 | 18 | 9 | 2 | 0 | 0 | 0 |

From Table 1 and FIG. 9, it was ascertained that the rate of plating deposition on the surface of a porous green body can be sufficiently held to low values when the resin filling ratio of the porous green body is not less than 60%, that the ratio of occurrence of poor characteristics after the packaging of a PTC on a wiring board can be sufficiently improved when the filling ratio is not less than 70%, and that the fraction defective in the bursting test can be sufficiently reduced when the filling ratio is not less than 80%.

Figure 10:
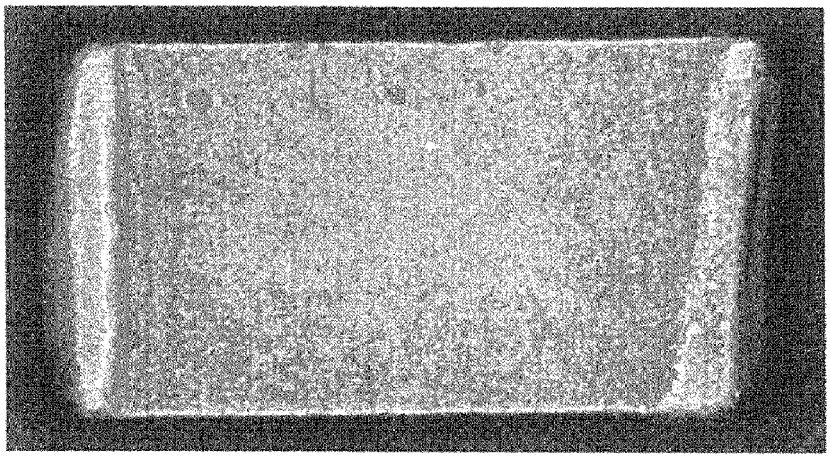
FIG. 10 is a plan appearance photograph of a porous green body of a PTC thermistor in a comparative example at a resin filling ratio of 0% (rate of plating deposition: 100%)
Figure 11:
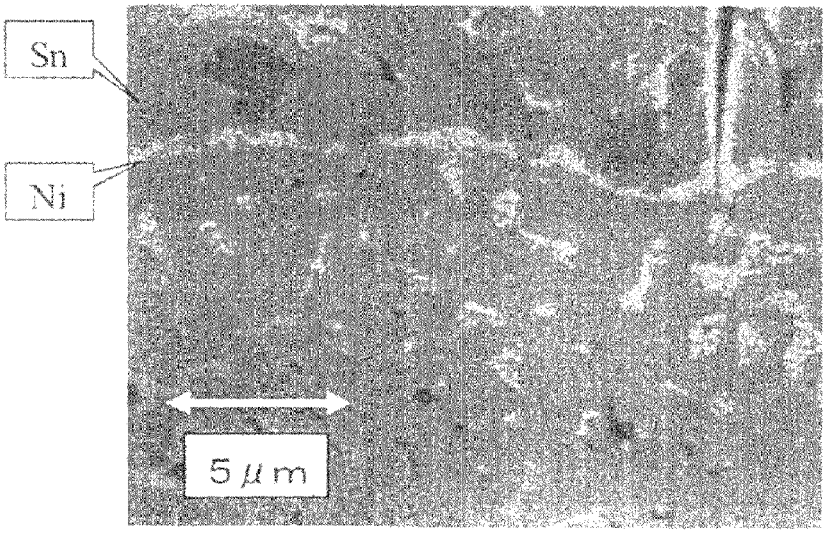
FIG. 11 is a sectional enlarged photograph of a subsurface part of a porous green body of a PTC thermistor in a comparative example at a resin filling ratio of 0% (rate of plating deposition: 100%)
Figure 12:
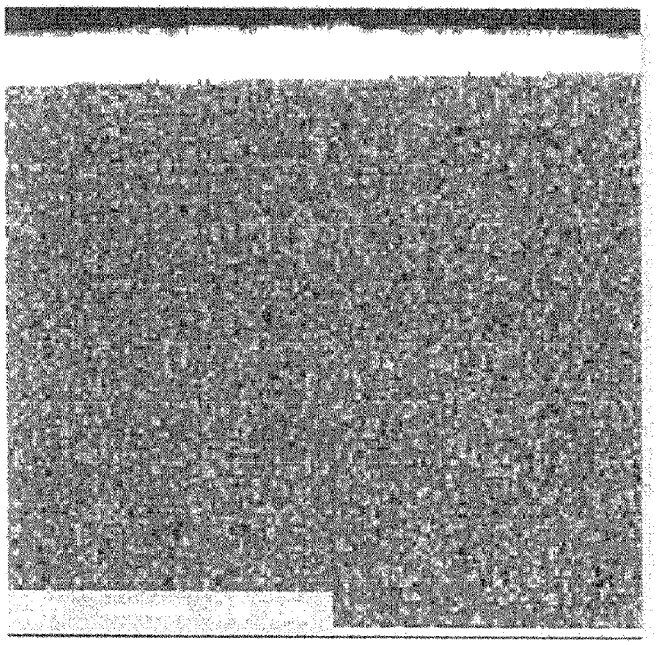
FIG. 12 is a diagram showing the element distribution of Ni obtained when a section of a subsurface part of a porous green body of a PTC thermistor in a comparative example at a resin filling ratio of 0% (rate of plating deposition: 100%) was observed by EPMA.
Figure 13:
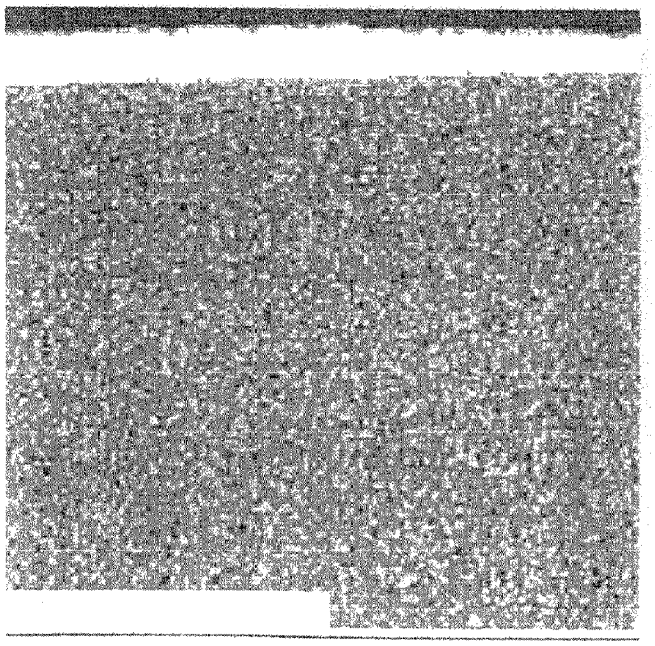
FIG. 13 is a diagram showing the element distribution of Sn obtained when a section of a subsurface part of a porous green body of a PTC thermistor in a comparative example at a resin filling ratio of 0% (rate of plating deposition: 100%) was observed by EPMA.

FIGS. 10 and 11 are a plan appearance photograph and a sectional enlarged photograph of a subsurface part, respectively, of a porous green body of a PTC thermistor in a comparative example with a resin filling ratio of 0% (rate of plating deposition: 100%). FIGS. 12 and 13 are a diagram showing the element distribution of Ni and Sn, respectively, obtained when the section was observed by an EPMA. From these results, it became apparent that in the PTC thermistor in which resin was not impregnated or filled in the porous green body, the surface of the porous green body has a metallic luster and that Ni had entered in a deep region of the interior of the porous green body.

Figure 14:
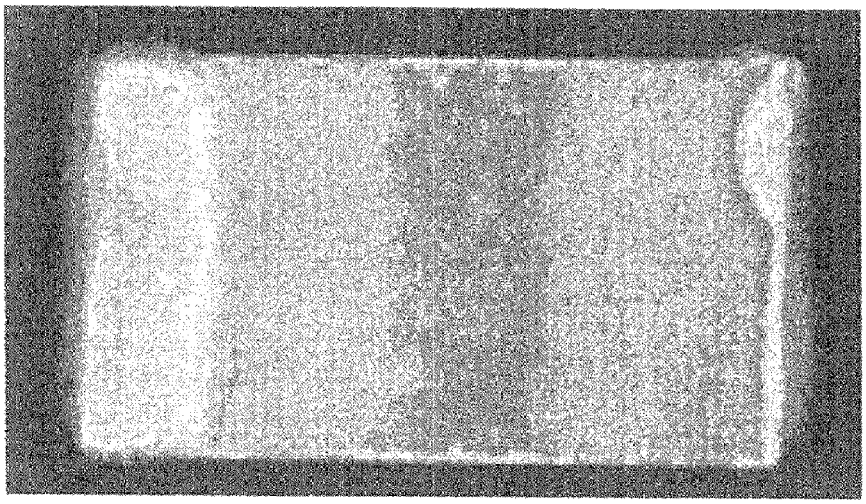
FIG. 14 is a plan appearance photograph of a porous green body of a PTC thermistor in a comparative example at a resin filling ratio of 42% (rate of plating deposition: 31%)
Figure 15:
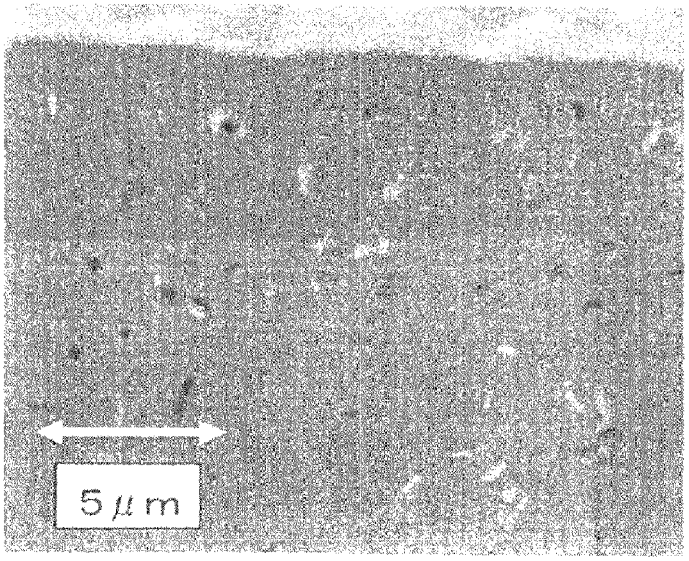
FIG. 15 is a sectional enlarged photograph of a subsurface part of a porous green body of a PTC thermistor in a comparative example at a resin filling ratio of 42% (rate of plating deposition: 31%)
Figure 16:
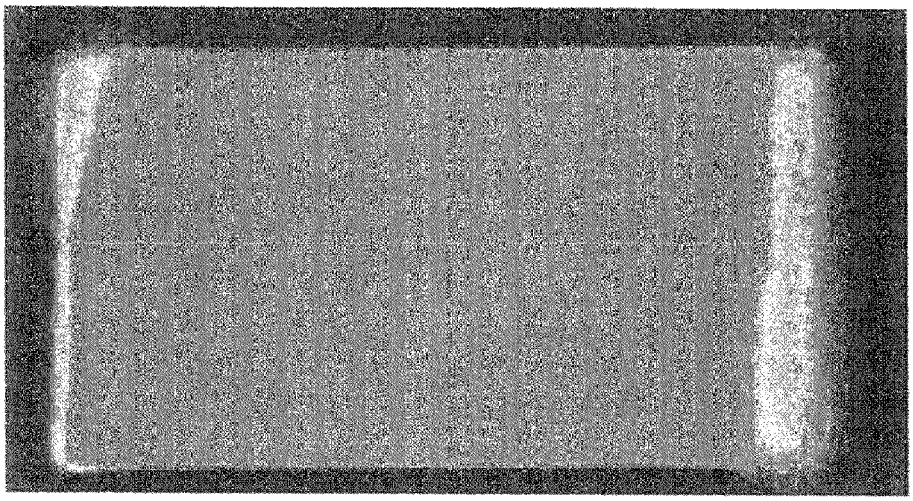
FIG. 16 is a plan appearance photograph of a porous green body of a PTC thermistor in a comparative example at a resin filling ratio of 56% (rate of plating deposition: 9.1%)
Figure 17:
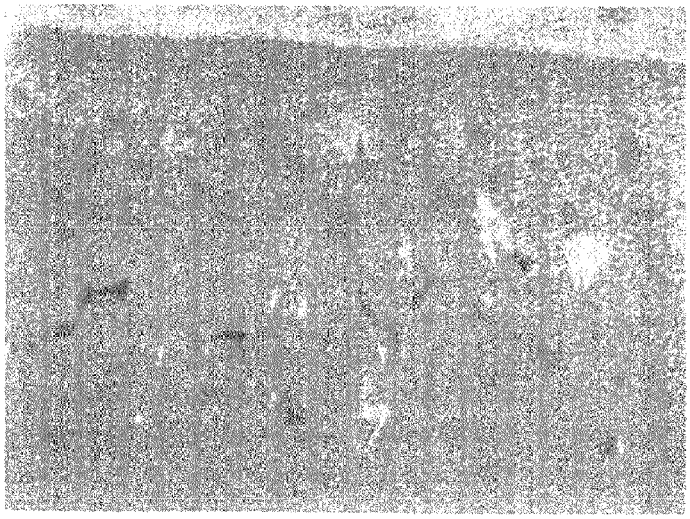
FIG. 17 is a sectional enlarged photograph of a subsurface part of a porous green body of a PTC thermistor in a comparative example at a resin filling ratio of 56% (rate of plating deposition: 9.1%)
Figure 18:
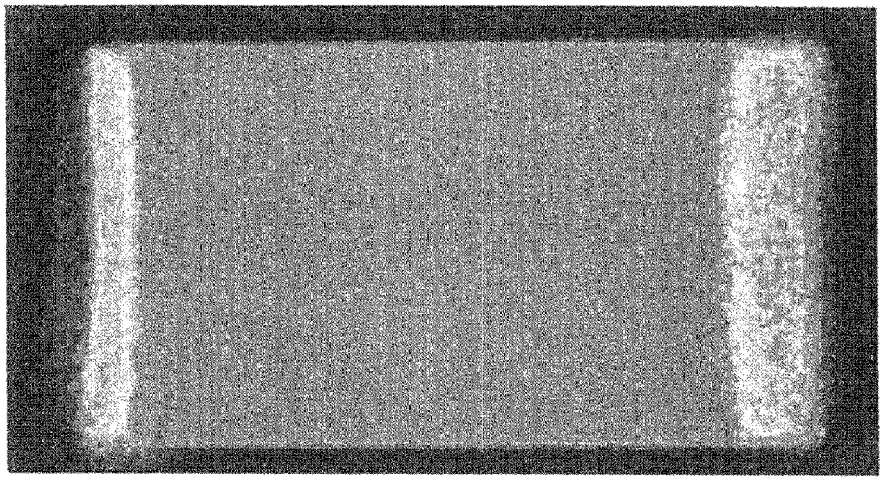
FIG. 18 is a plan appearance photograph of a porous green body of a PTC thermistor in an example at a resin filling ratio of 82% (rate of plating deposition: 3.2%)
Figure 19:
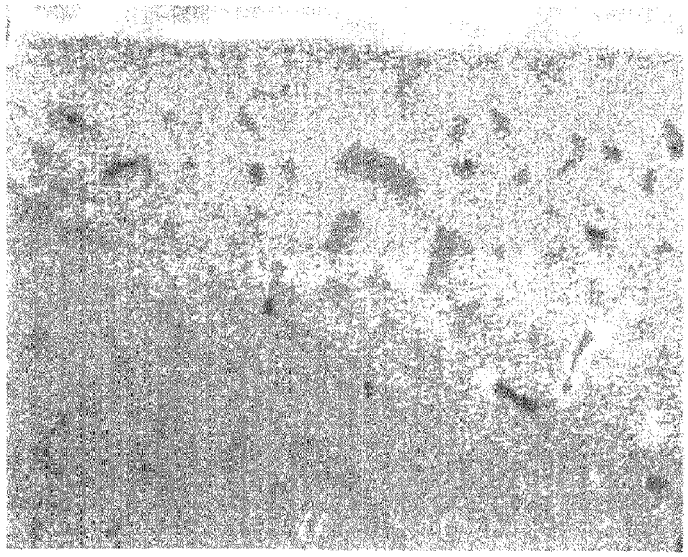
FIG. 19 is a sectional enlarged photograph of a subsurface part of a porous green body of a PTC thermistor in an example at a resin filling ratio of 82% (rate of plating deposition: 3.2%)
Figure 20:
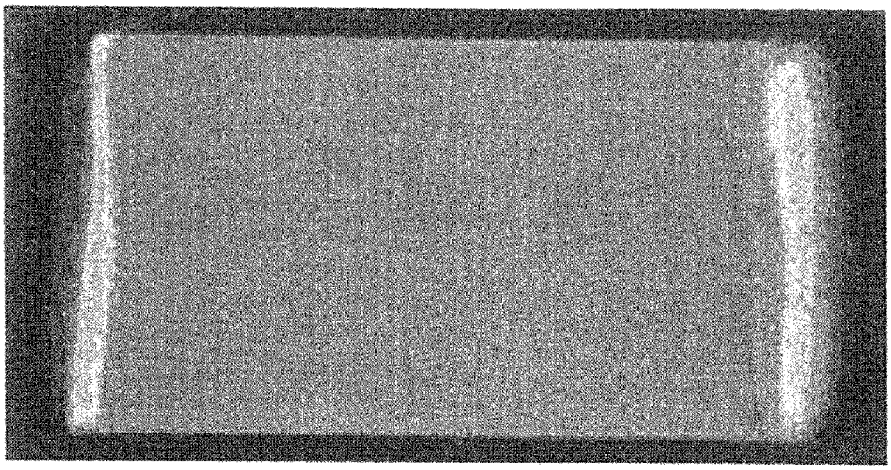
FIG. 20 is a plan appearance photograph of a porous green body of a PTC thermistor in an example with a resin filling ratio of 98% (rate of plating deposition: 0.5%)
Figure 21:
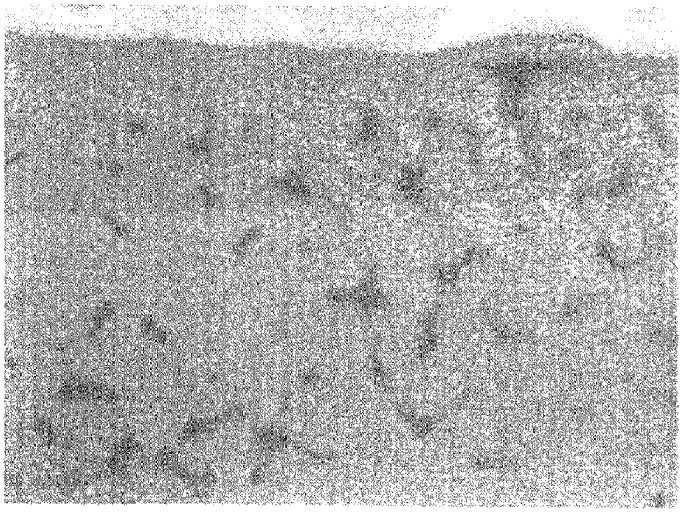
FIG. 21 is a sectional enlarged photograph of a subsurface part of a porous green body of a PTC thermistor in an example at a resin filling ratio of 98% (rate of plating deposition: 0.5%)

FIGS. 14 and 15 are a plan appearance photograph and a sectional enlarged photograph of a subsurface part, respectively, of a porous green body of a PTC thermistor in a comparative example at a resin filling ratio of 42% (rate of plating deposition: 31%). FIGS. 16 and 17 are a plan appearance photograph and a sectional enlarged photograph of a subsurface part, respectively, of a porous green body of a PTC thermistor in a comparative example at a resin filling ratio of 56% (rate of plating deposition: 9.1%). FIGS. 18 and 19 are a plan appearance photograph and a sectional enlarged photograph of a subsurface part, respectively, of a porous green body of a PTC thermistor in an example at a resin filling ratio of 82% (rate of plating deposition: 3.2%). FIGS. 20 and 21 are a plan appearance view and a sectional enlarged photograph of a subsurface part of a porous green body, respectively, of a PTC thermistor in an example at a resin filling ratio of 98% (rate of plating deposition: 0.5%).

REFERENCE EXAMPLES 1 TO 6

Figure 22:
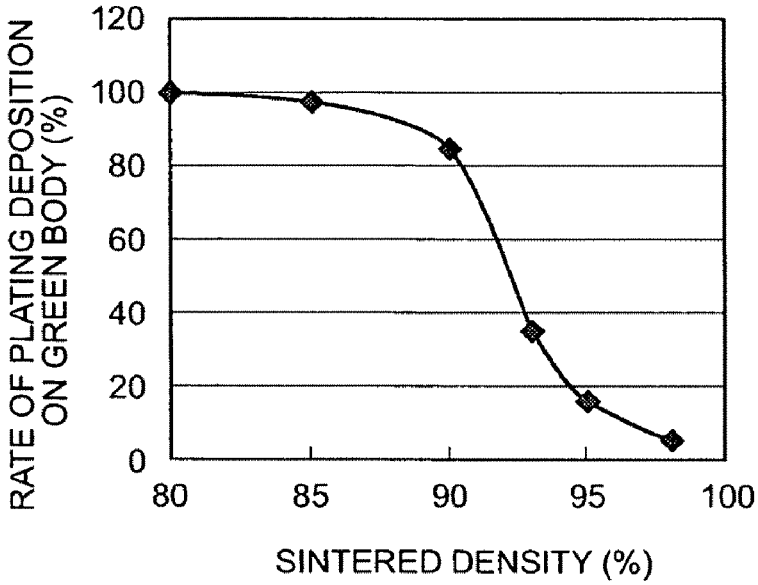
FIG. 22 is a graph showing the rate of plating deposition on the surface of a porous green body relative to the sintered density of the porous green body.

By changing the sintered density of the porous green body 2, PTC thermistors were manufactured by following the same procedure as in Comparative Example 1, and the relationship between sintered density and the rate of plating deposition on the surface of a porous green body was evaluated. The results are summarized in Table 2. FIG. 22 is a graph of the data of Table 1.

TABLE 2

| | | | | | | |
|---|---|---|---|---|---|---|
| Sintered density (%) | 80 | 85 | 90 | 93 | 95 | 98 |
| Rate of plating deposition on green body surface (%) | 100 | 98 | 85 | 35 | 16 | 5 |

From Table 2 and FIG. 22, it became apparent that when the sintered density of a porous green body is not more than 90%, plating deposition is remarkable to such an extent that the rate of plating deposition exceeds 80%, whereas at sintered densities exceeding 90%, the rate of plating deposition decreases abruptly, with the result that plating deposition occurs to such an extent that inconvenience scarcely occurs.

According to a stacked electronic part of the present invention and a method of manufacturing the stacked electronic part, because a plurality of vacancies contained in a porous green body are filled with resin at a filling ratio of not less than 60%, the plating liquid is prevented from entering through the open pores of the porous green body and flowing into the internal electrode and hence plating deposition on the porous green body is sufficiently suppressed. Therefore, the disadvantage that the reliability of products decreases can be eliminated and it is possible to effectively prevent the occurrence of poor characteristics that may occur when high temperatures are applied and the occurrence of "bursting" that may occur at high temperatures.

The present invention can be widely used in a stacked electronic part formed from a thermistor, a capacitor, an inductor, LTCC (Low Temperature Co-fired Ceramics) and a varistor and from a complex thereof, equipment, devices, systems and facilities provided with this stacked electronic part, and in the manufacturing thereof.

The present application is based on Japanese priority applications No. 2007-191583 filed on Jul. 24, 2007 and No. 2008-068230 filed on Mar. 17, 2008, the entire contents of which are hereby incorporated by reference.

What is claimed is:

1. A stacked electronic part, comprising:

a stacked body that has a porous green body made mainly of ceramics and containing a plurality of vacancies and at least one internal electrode provided within the porous green body;

an external electrode connected to the internal electrode; and a terminal electrode formed on the external electrode by plating, wherein the porous green body is such that addition polymerization type silicone resin is filled in the plurality of vacancies at a filling ratio of not less than 60%.

2. The stacked electronic part according to claim 1, wherein the porous green body is a burned body and has a sintered density of not more than 90%.

3. A method of manufacturing a stacked electronic part, comprising the steps of:

forming a stacked structure by providing at least one internal electrode within a porous green body made mainly of ceramics and containing a plurality of vacancies;

forming a stacked body by burning the stacked structure;

applying an electrically conductive paste to the stacked body so as to obtain an electrical connection to the internal electrode of the stacked body;

forming an external electrode by burning the electrically conductive paste;

filling addition polymerization type silicone resin in the plurality of vacancies at a filling ratio of not less than 60% by impregnating the addition polymerization type silicone resin in the porous green body; and forming a terminal electrode on the external electrode by plating.

* * * * *